US007757654B2

(12) United States Patent
Nagafuchi et al.

(10) Patent No.: US 7,757,654 B2
(45) Date of Patent: Jul. 20, 2010

(54) CYLINDER HEAD

(75) Inventors: Hiroki Nagafuchi, Susono (JP); Toshio Itou, Susono (JP)

(73) Assignee: Toyota Jidosha Kabushiki Kaisha, Toyota-shi, Aichi-ken (JP)

( * ) Notice: Subject to any disclaimer, the term of this patent is extended or adjusted under 35 U.S.C. 154(b) by 60 days.

(21) Appl. No.: 11/979,858

(22) Filed: Nov. 9, 2007

(65) Prior Publication Data

US 2008/0110431 A1 May 15, 2008

(30) Foreign Application Priority Data

Nov. 10, 2006 (JP) ..... 2006-304921

(51) Int. Cl.
*F02F 1/36* (2006.01)
*F02F 1/42* (2006.01)

(52) U.S. Cl. ..... 123/193.5

(58) Field of Classification Search ..... 123/193.5, 123/196 M, 572–574; 60/321, 323, 324
See application file for complete search history.

(56) References Cited

U.S. PATENT DOCUMENTS 4,165,612 A * 8/1979 Fujioka et al. ..... 60/322
6,470,867 B2 * 10/2002 Akiwa et al. ..... 123/672
6,513,506 B1 * 2/2003 Ito et al. ..... 123/568.13
2003/0098005 A1 5/2003 Ito et al.
2007/0079801 A1 * 4/2007 Aw ..... 123/315

FOREIGN PATENT DOCUMENTS

| | | |
|---|---|---|
| JP | 52-118810 | 9/1977 |
| JP | 52-128801 | 9/1977 |
| JP | 54-155010 | 10/1979 |
| JP | 63-26753 | 2/1988 |
| JP | 2002-70641 | 3/2002 |
| JP | 3605521 | 10/2004 |

* cited by examiner

*Primary Examiner*—M. McMahon
(74) *Attorney, Agent, or Firm*—Finnegan, Henderson, Farabow, Garrett & Dunner, LLP

(57) ABSTRACT

A cylinder head in which a partition wall for separating exhaust ports of adjoining cylinders extends from between these adjoining cylinders to an exhaust merging portion and the partition wall is formed with a head bolt insertion hole inside it, an oil passage is formed in the partition wall between the front end of the partition wall facing the exhaust merging portion and the head bolt insertion hole, and a heat insulating layer is formed inside the partition wall between the front end of the partition wall and the oil passage.

3 Claims, 7 Drawing Sheets

CYLINDER HEAD

BACKGROUND OF THE INVENTION

1. Field of the Invention

The present invention relates to a cylinder head.

2. Description of the Related Art

Known in the art is a cylinder head where exhaust ports of adjoining cylinders are gathered together at an exhaust merging portion inside the cylinder head, a partition wall separating the exhaust ports of these adjoining cylinders extends from between these adjoining cylinders to the exhaust merging portion, a head bolt insertion hole is formed inside the partition wall, and an oil passage is formed inside the partition wall between the front end of the partition wall facing the exhaust merging portion and the head bolt insertion hole (see Japanese Patent No. 3605521). In an internal combustion engine provided with this cylinder head, the temperature of the exhaust merging portion where the exhaust gas is collected from the cylinders becomes particularly high, so the temperature near the front end of the partition wall facing this exhaust merging portion becomes the highest. Therefore, in this internal combustion engine, the temperature of the inner circumference of the oil passage formed inside the partition wall becomes high, so at the time of a low temperature, the oil flowing through the oil passage is quickly made to rise in temperature.

On the other hand, in an internal combustion engine provided with this cylinder head, there is a danger of the oil overheating. Therefore, there is known a cylinder head forming a cooling water passage adjoining the oil passage inside the partition wall (see Japanese Patent Publication (A) No. 2002-70641). In an internal combustion engine provided with this cylinder head, the oil passage is cooled by the cooling water flowing inside the cooling water passage, so the oil can be prevented from overheating.

In this way, when using the cylinder head described in Japanese Patent No. 3605521, the problem arises that the oil flowing inside the oil passage is overheated and the oil ends up being baked on the inner circumference of the oil passage. Further, in the case of using the cylinder head described in Japanese Patent Publication (A) No. 2002-70641, the temperatures of the inner circumference of the oil passage positioned at the side of the cooling water passage fall, but no means is provided for suppressing the transfer of heat between the inner circumference of the oil passage positioned at the opposite side to the cooling water passages and the front end of the partition wall, so the problem arises that the inner circumference of the oil passage positioned at the opposite side to the cooling water passage is overheated and therefore the oil ends up being baked on the inner circumference of the oil passage.

Further, in the cylinder heads described in Japanese Patent No. 3605521 and Japanese Patent Publication (A) No. 2002-70641, no particular care is given to suppressing the transfer of heat to the head bolt insertion hole boss formed inside the partition wall, so the temperatures of the head bolt insertion hole boss formed inside the partition wall becomes considerably higher than other head bolt insertion hole bosses. As a result, the head bolt insertion hole boss formed inside the partition wall expands by heat greater than the other head bolt insertion hole bosses, so great compressive stress is formed in the head bolt insertion hole boss formed inside the partition wall and therefore there is the problem that the head bolt insertion hole boss formed inside the partition wall drops in durability.

SUMMARY OF THE INVENTION

An object of the present invention is to provide a cylinder head able to prevent oil from being baked on the inner circumferences of the oil passages and to improve the durability of the head bolt insertion hole bosses.

According to the present invention, there is provided a cylinder head where exhaust ports of adjoining cylinders are gathered together at an exhaust merging portion inside a cylinder head, a partition wall separating the exhaust ports of these adjoining cylinders extends from between these adjoining cylinders to the exhaust merging portion, a head bolt insertion hole is formed inside the partition wall, and an oil passage is formed inside the partition wall between the front end of the partition wall facing the exhaust merging portion and the head bolt insertion hole, wherein a heat insulating layer is formed inside the partition wall between the front end of the partition wall and the oil passage.

In the present invention, since a heat insulating layer is formed between the front end of the partition wall and the oil passage, the transfer of heat from the front end of the partition wall toward the oil passage is blocked or suppressed by the heat insulating layer and therefore oil inside the oil passage can be prevented from being baked on the inner circumference of the oil passage. Further, if viewed from the cylinder head side, the oil passage forms a transferred heat absorption layer. Therefore, in the present invention, heat insulating layer and transferred heat absorption layer are arranged in series between the front end of the partition wall and the head bolt insertion hole, so the transfer of heat from the front end of the partition wall to around the head bolt insertion hole is suppressed and therefore the durability of the head bolt insertion hole boss can be improved.

BRIEF DESCRIPTION OF THE DRAWINGS

These and other objects and features of the present invention will become more apparent from the following description of the preferred embodiments given with reference to the attached drawings, in which.

DESCRIPTION OF THE PREFERRED EMBODIMENTS

Figure 1:
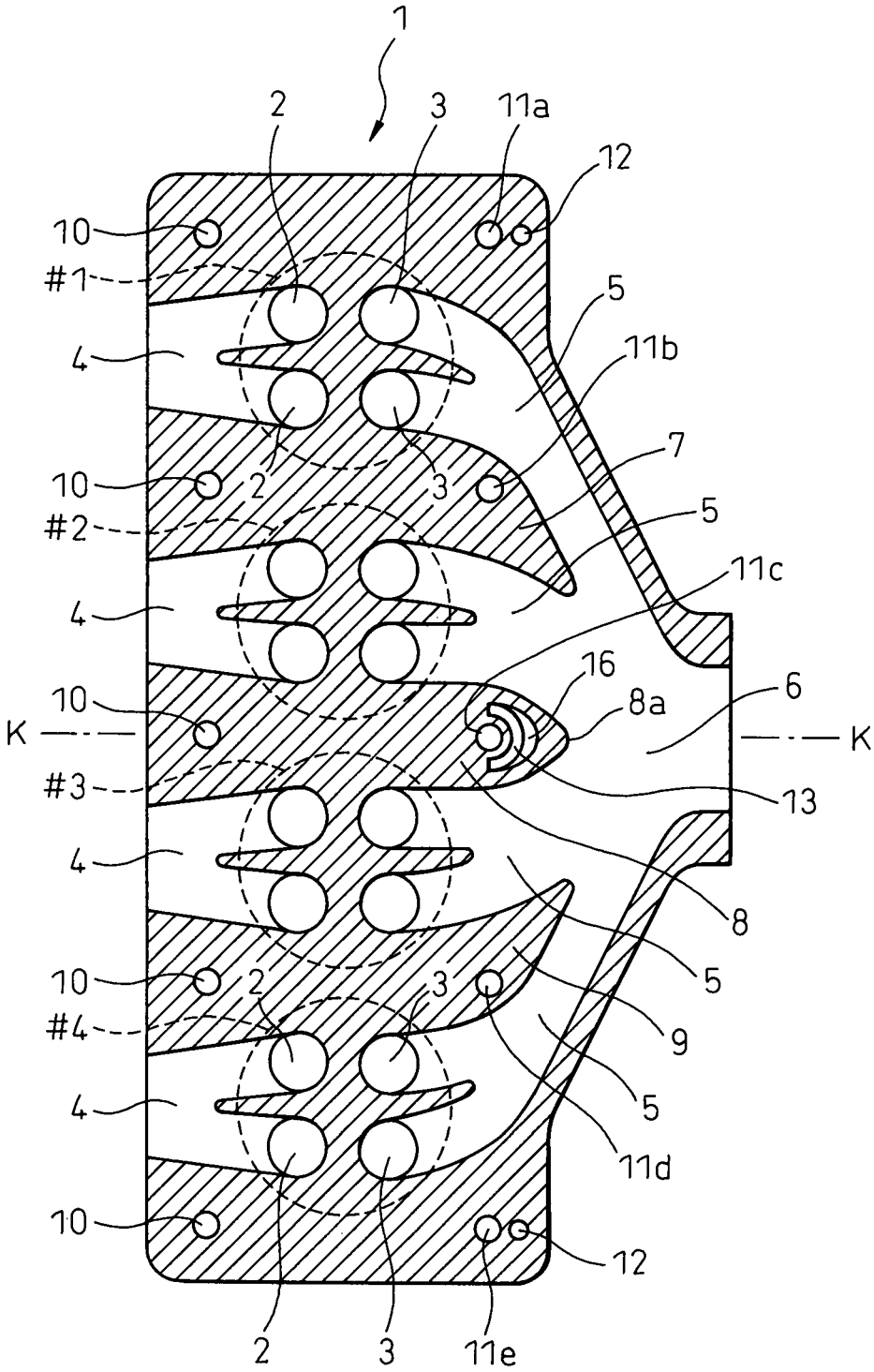
FIG. 1 is a cross-sectional plan view of a cylinder head.

FIG. 1 is a cross-sectional plan view of a cylinder head 1 cast integrally from for example an aluminum alloy. Note that in FIG. 1, the circles shown by the broken lines show the positions of the No. 1 cylinder #1, No. 2 cylinder #2, No. 3 cylinder #3, and No. 4 cylinder #4. Therefore, it will be understood that the internal combustion engine provided with the cylinder head 1 shown in FIG. 1 is an in-line four-cylinder internal combustion engine. In FIG. 1, 2 indicate valve ports opened and closed by intake valves, while 3 indicate valve ports opened and closed by exhaust valves. Therefore, it will be understood that each of the cylinders #1, #2, #3, and #4 is provided with a pair of intake valves and a pair of exhaust valves.

Note that the cylinder head 1 is actually formed with cooling water passages extending along complicated paths, support parts of the valve mechanisms, insertion holes for the spark plugs, insertion holes for the fuel injectors, etc., but these are omitted in FIG. 1.

Inside the cylinder head 1, intake ports 4 for the cylinders #1, #2, #3, #4 and exhaust ports 5 for the cylinders #1, #2, #3, #4 are formed. As will be understood in FIG. 1, the intake ports 4 and exhaust ports 5 are arranged symmetrically with respect to a symmetrical plane K-K passing through the center of the longitudinal axis of the cylinder head 1 and vertical to the longitudinal axis of the cylinder head 1. All of the exhaust ports 5 are gathered together at the exhaust merging portion 6.

As shown in FIG. 1, a partition wall 7 extends from between the adjoining No. 1 cylinder #1 and No. 2 cylinder #2 to the exhaust merging portion 6 for separating the exhaust ports 5 of these adjoining cylinders #1 and #2, a partition wall 8 extends from between the adjoining No. 2 cylinder #2 and No. 3 cylinder #3 to the exhaust merging portion 6 for separating the exhaust ports 5 of these adjoining cylinders #2 and #3, and a partition wall 9 extends from between the adjoining No. 3 cylinder #3 and No. 4 cylinder #4 to the exhaust merging portion 6 for separating the exhaust ports 5 of these adjoining cylinders #3 and #4.

Regarding the intake port 4 side, five head bolt insertion holes 10 are formed in the cylinder head 1 arranged on a line so as to be positioned at the two sides of the intake ports 4. Regarding the exhaust port 5 side as well, five head bolt insertion holes 11*a*, 11*b*, 11*c*, 11*d*, 11*e* are formed in the cylinder head 1 arranged on a line so as to be positioned at the two sides of the exhaust ports 5. Among the five head bolt insertion holes of the exhaust port 5 side, the three head bolt insertion holes 11*b*, 11*c*, and 11*d* are formed at the corresponding partition walls 7, 8, and 9 and the two head bolt insertion holes 11*a*, 11*e* are formed at the outsides of the group of intake ports.

Near the head bolt insertion holes 11*a*, 11*e* formed at the outsides of the group of intake ports, oil passages 12 are formed. An oil passage 13 is also formed near the head bolt insertion hole 11*c* formed in the partition wall 8. The oil passages 12, 13 are formed near the head bolt insertion holes 11*a*, 11*c*, 11*e* in this way so as to prevent oil inside the oil passages 12, 13 from leaking from between the cylinder head 1 and cylinder block when using head bolts inserted into the head bolt insertion holes 10, 11*a* and 11*e* to fasten the cylinder head 1 to the cylinder block. That is, since no clearance is formed between the cylinder head 1 around the head bolts and the mating surfaces of the cylinder block, if forming aligned oil passages inside the cylinder head 1 near the head bolts and inside the cylinder block, it is possible to prevent oil from leaking from the connecting parts of these oil passages.

Now, as explained above, if the temperatures of the oil passages rise, oil ends up being baked on the inner circumferences of the oil passages. Further, if the temperatures around the head bolt insertion holes rise, a large compressive stress is formed around the head bolt insertion holes, so the durability of the areas around the head bolt insertion holes ends up falling. However, exhaust gas is successively discharged from the cylinders #1, #2, #3, #4 during one cycle. The greater the number of times of contact with the exhaust gas successively discharged from the cylinders, the higher the temperatures.

Seen from this viewpoint, the partition wall 7 contacts the exhaust gas discharged from the No. 1 cylinder #1 and the exhaust gas discharged from the No. 2 cylinder #2, so the partition wall 7 contacts the exhaust gas twice in one cycle. Similarly, the partition wall 9 contacts the exhaust gas twice in one cycle. As opposed to this, the front end of the partition wall 8 contacts the exhaust gas discharged from all of the cylinders #1, #2, #3, #4, so contacts the exhaust gas four times in one cycle. Therefore, the temperature of the front end of the partition wall 8 becomes the highest in the cylinder head 1.

Therefore, among the oil passages, the oil in the oil passage 13 formed inside the partition wall 8 most easily is baked on to the inner circumference of the oil passage 13, while among the head bolt insertion holes, the strength around the head bolt insertion hole 11*c* formed inside the partition wall 8 mostly easily degrades. Therefore, in the present invention, in particular, the temperatures in the oil passage 13 and around the head bolt insertion hole 11*c* formed inside the partition wall 8 are kept from rising.

Figure 2:
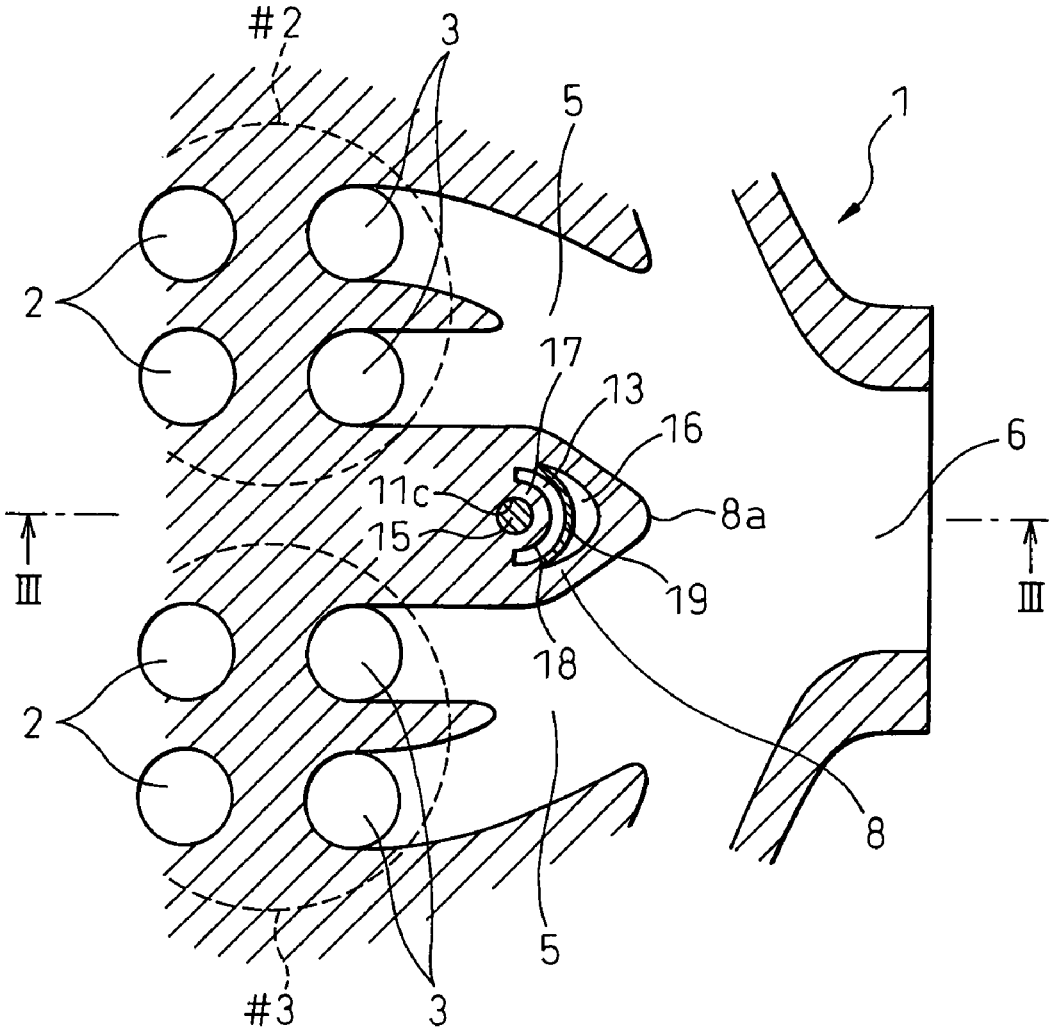
FIG. 2 is an enlarged view around a partition wall of FIG. 1.
Figure 3:
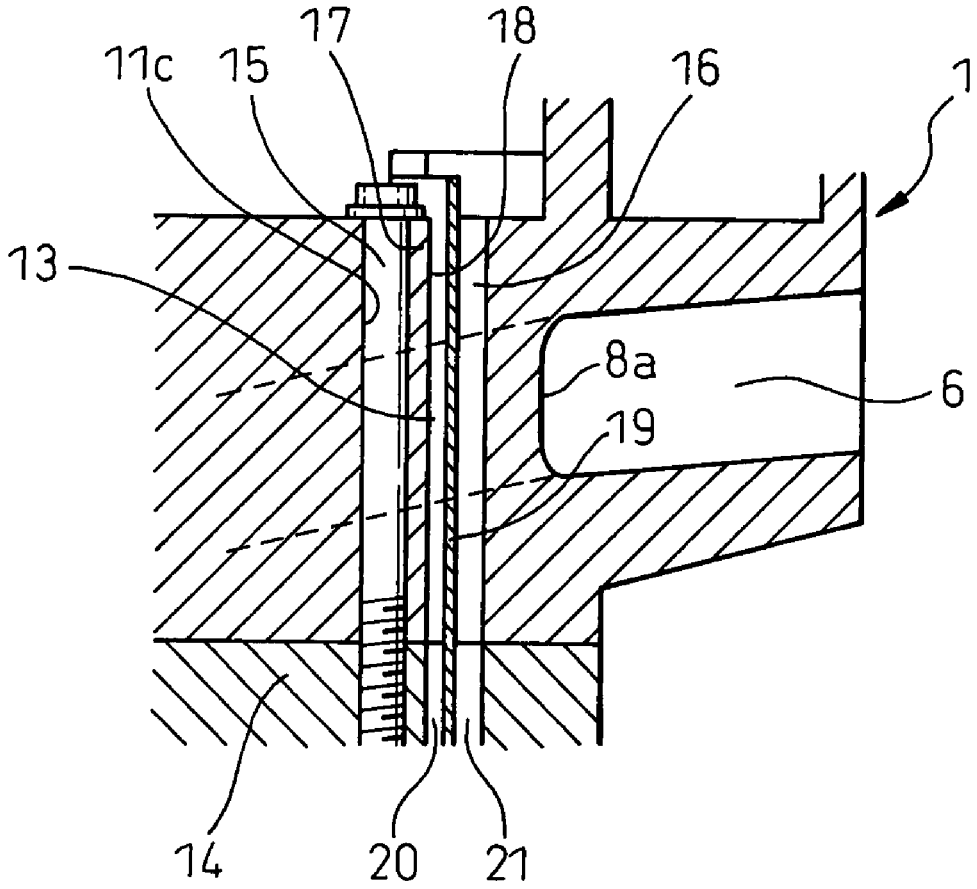
FIG. 3 is a cross-sectional view seen along the line III-III of FIG. 2.

FIG. 2 is an enlarged view of the area around the partition wall 8 of FIG. 1, while FIG. 3 is a cross-sectional view seen along the line III-III of FIG. 2. Referring to FIG. 2 and FIG. 3, the cylinder head 1 is placed on a cylinder block 14. This cylinder head 1 is fastened on the cylinder block 14 by a head bolt 15 inserted into the head bolt insertion hole 11*c*. Note that the other head bolt insertion holes 10, 11*a*, 11*b*, 11*d*, 11*e* also have head bolts similar to the head bolt 15 shown in FIG. 3 inserted into them.

As shown in FIG. 2 and FIG. 3, according to the present invention, a heat insulating layer 16 is formed between the front end 8*a* of the partition wall 8 facing the exhaust merging portion 6 and the oil passage 13. Specifically, around the head bolt insertion hole 11*c*, a boss of the head bolt insertion hole 11*c* is formed. The boss 17 of the partition wall front end 8*a* side forms a hollow cylindrical shape extending over substantially half the circumference around the axis of the head bolt insertion hole 11*c*.

As shown in FIG. 2, around the boss 17, a thin partition wall 19 extending in an arc shape around the axis of the head bolt insertion hole 11*c* is formed a certain distance from the semicylindrical outer circumference 18 of the boss 17. In the embodiment shown in FIG. 2 and FIG. 3, this thin partition wall 19 is formed with the cylinder head 1 in one piece. The oil passage 13 is formed between the semicylindrical outer circumference 18 of the boss 17 and the thin partition wall 19. This oil passage 13 extends in an arc shape across substantially half the circumference around the axis of the head bolt insertion hole 11*c* along the semicylindrical outer circumference 18 of the boss 17.

On the other hand, the heat insulating layer 16 extends around the axis of the head bolt insertion hole 11*c* along the outer edge of the oil passage 13 at the partition wall front end 8*a* side. Specifically, the heat insulating layer 16 extends around the axis of the head bolt insertion hole 11*c* along the outer circumference of the thin partition wall 19.

As shown in FIG. 3, the top end of the thin partition wall 19 sticks up above the top wall surface of the cylinder head 1 so as to be able to catch oil led on to the cylinder head 1 inside the oil passage 13, while the bottom end of the oil passage 13 is communicated with an oil passage 20 formed in the cylinder block 14. On the other hand, in the embodiment shown in FIG. 2 and FIG. 3, the heat insulating layer 16 is comprised of a blowby gas passage. This blowby gas passage 16 is communicated with a blowby gas passage 21 of the cylinder block 14.

As shown from FIG. 1 to FIG. 3, according to the present invention, the heat insulating layer 16 completely covering the partition wall front end 8*a* side of the oil passage 13 is formed between the front end 8*a* of the partition wall 8 and the oil passage 13, so the transfer of heat from the partition wall front end 8*a* toward the oil passage 13 is blocked or suppressed by the heat insulating layer 16 and therefore the oil inside the oil passage 13 can be prevented from being baked on the inner circumference of the oil passage 13.

Further, seen from the cylinder head 1 side, the oil passage 13 forms a transferred heat absorption layer. Therefore, in the present invention, the heat insulating layer 16 and transferred heat absorption layer 13 are arranged in series between the partition wall front end 8*a* and head bolt insertion hole 11*c*, so the transfer of heat from the partition wall front end 8*a* to around the head bolt insertion hole 11*c* is suppressed. Further, these heat insulating layer 16 and transferred heat absorption layer 13 extend so as to completely cover the exhaust merging portion 6 side of the boss 17, so the transfer of heat from the partition wall front end 8*a* to around the head bolt insertion hole 11*c* is greatly suppressed and therefore the durability of the boss 17 of the head bolt insertion hole 11*c* can be improved.

Figure 4:
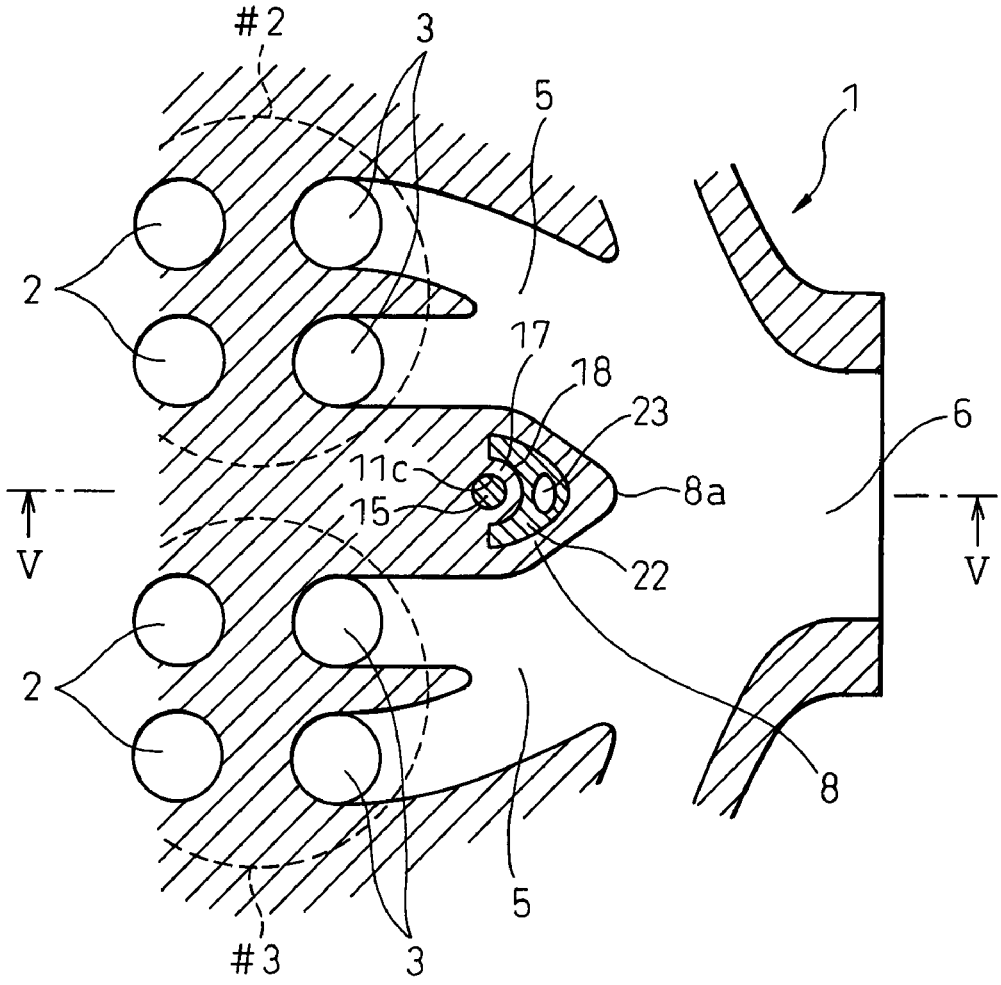
FIG. 4 is a plan cross-sectional view of another embodiment of a cylinder head showing the area around a partition wall.
Figure 5:
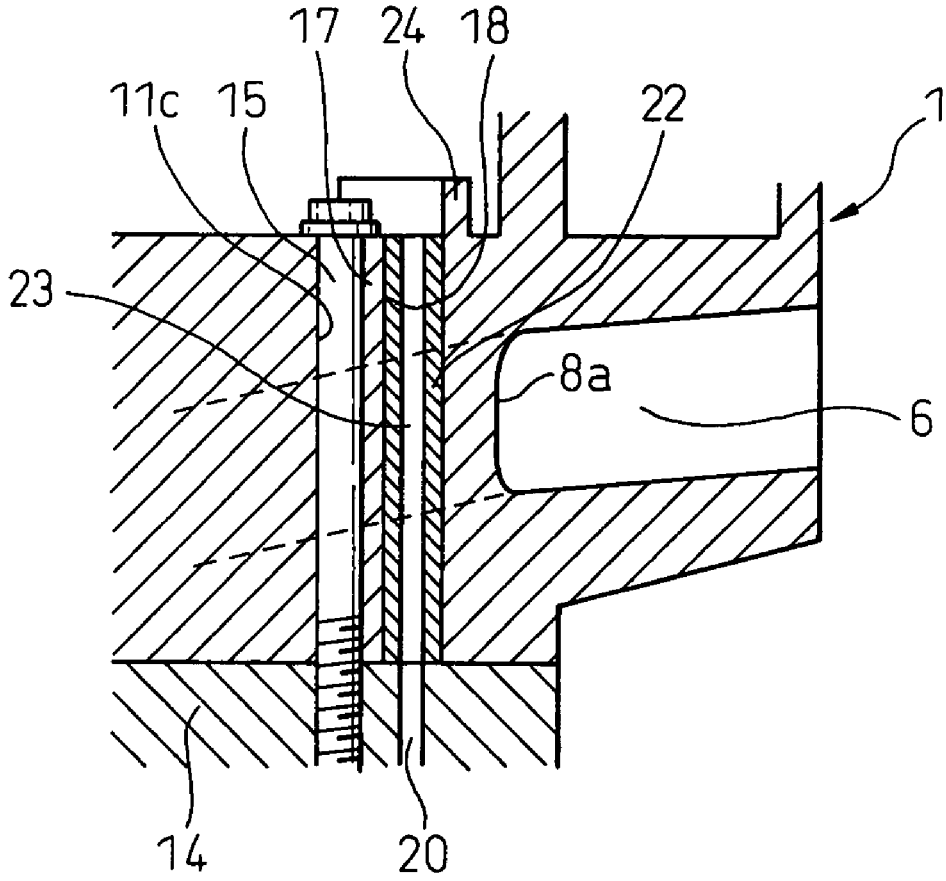
FIG. 5 is a cross-sectional view seen along the line V-V of FIG. 4.

FIG. 4 and FIG. 5 show another embodiment. In this embodiment, a heat insulating layer 22 is formed extending in an arc across substantially half the circumference around the axial line of the head bolt insertion hole 11*c* along the semicylindrical outer circumference of the boss 17. At the center part of this heat insulating layer 22, an oil passage 23 is formed. Therefore, in this embodiment as well, a heat insulating layer 22 is formed between the front end 8*a* of the partition wall 8 and the oil passage 23.

As will be understood from FIG. 4 and FIG. 5, the heat insulating layer 22 is filled with a heat insulating material, while the oil passage 23 is formed inside the heat insulating material. Further, on the cylinder head 1, a standing lip 24 is formed extending along the outer edge of the heat insulating layer 22 so as to catch the oil.

In this embodiment as well, a heat insulating layer 22 is formed between the front end 8*a* of the partition wall 8 and the oil passage 23, so the transfer of heat from the partition wall front end 8*a* toward the oil passage 23 is blocked or suppressed by the heat insulating layer 22 and therefore the oil in the oil passage 23 can be prevented from being baked on the inner circumference of the oil passage 23. Further, in this embodiment as well, a heat insulating layer 22 and a transferred heat absorption layer 23 are arranged in series between the partition wall front end 8*a* and head bolt insertion hole 11*c*, so the transfer of heat from the partition wall front end 8*a* to around the head bolt insertion hole 11*c* is suppressed and therefore the durability of the boss 17 can be improved.

Figure 6:
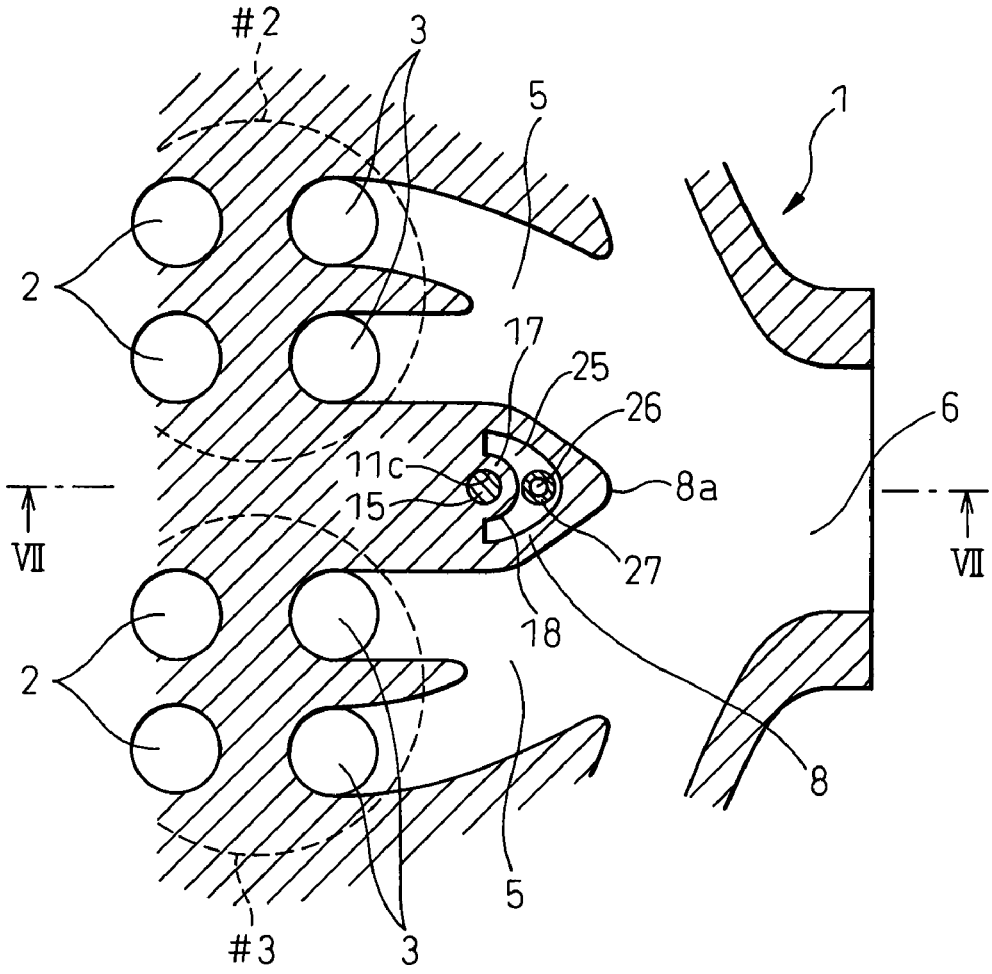
FIG. 6 is a cross-sectional plan view of still another embodiment of a cylinder head showing the area around a partition wall.
Figure 7:
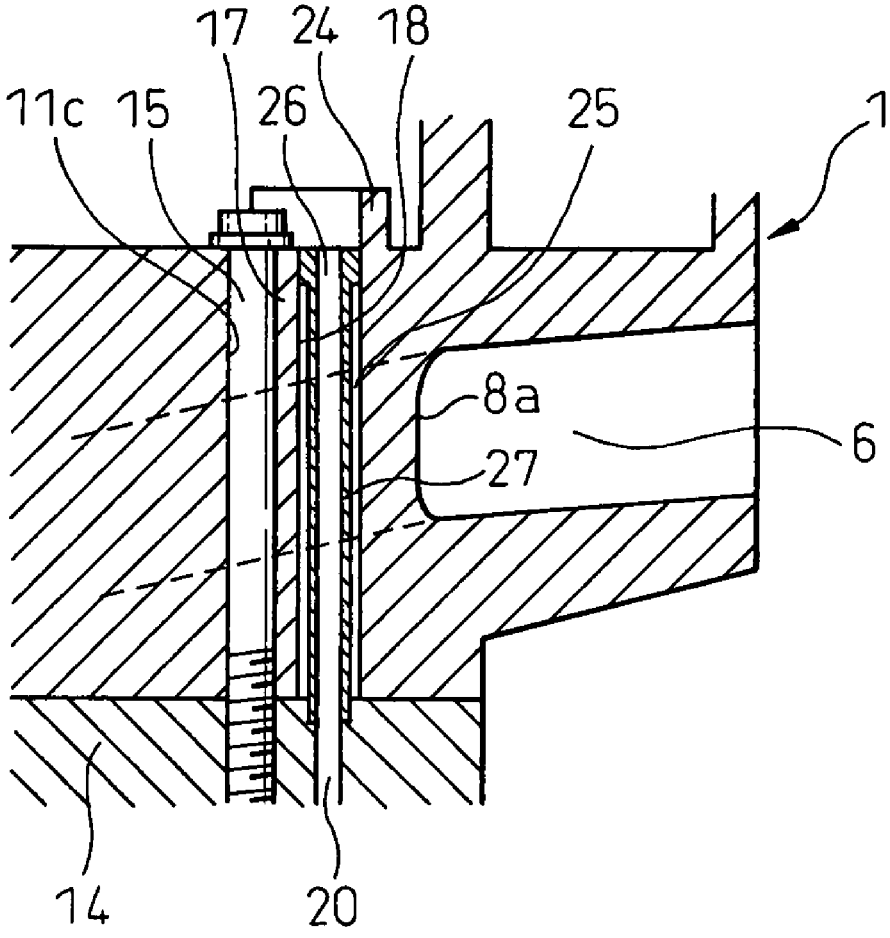
FIG. 7 is a cross-sectional view seen along the line VII-VII of FIG. 6.

FIG. 6 and FIG. 7 show still another embodiment. In this embodiment as well, a heat insulating layer 25 is formed extending in an arc across substantially half the circumference around the axial line of the head bolt insertion hole 11*c* along the semicylindrical outer circumference of the boss 17. At the center part of this heat insulating layer 25, an oil passage 26 is formed. Therefore, in this embodiment as well, a heat insulating layer 25 is formed between the front end 8*a* of the partition wall 8 and the oil passage 26.

As shown in FIG. 6 and FIG. 7, in this embodiment, the oil passage 26 is formed inside a pipe 27 extending through the center part of the heat insulating layer 25. The heat insulating layer 25 around the pipe 27 is comprised of a hollow space. In this embodiment as well, a heat insulating layer 25 is formed between the front end 8*a* of the partition wall 8 and the oil passage 26, so the transfer of heat from the partition wall front end 8*a* toward the oil passage 26 is blocked or suppressed and therefore the oil in the oil passage 26 can be prevented from being baked on the inner circumference of the oil passage 26. Further, in this embodiment as well, the heat insulating layer 25 and transferred heat absorption layer 26 are formed in series between the partition wall front end 8*a* and the head bolt insertion hole 11*c*, so the transfer of heat from the partition wall front end 8*a* to around the head bolt insertion hole 11*c* is suppressed and therefore the durability of the boss 17 can be improved.

While the invention has been described with reference to specific embodiments chosen for purpose of illustration, it should be apparent that numerous modifications could be made thereto by those skilled in the art without departing from the basic concept and scope of the invention.

The invention claimed is:

1. A cylinder head where exhaust ports of adjoining cylinders are gathered together at an exhaust merging portion inside a cylinder head, a partition wall separating the exhaust ports of these adjoining cylinders extends from between these adjoining cylinders to the exhaust merging portion, a head bolt insertion hole is formed inside the partition wall, and an oil passage is formed inside the partition wall between a front end of the partition wall facing the exhaust merging portion and the head bolt insertion hole, wherein a heat insulating layer is formed inside the partition wall between the front end of the partition wall and the oil passage, wherein the oil passage extends about the axis of the heat bolt insertion hole along the outer edges of the head bolt insertion hole boss at said partition wall front end side, and said heat insulating layer extends about the axis of the head bolt insertion hole along the outer edge of the oil passage of said partition wall front end side.

2. A cylinder head as set forth in claim 1, wherein the oil passage extends in an arc shape about the axis of the head bolt insertion hole along substantially half of the circumference of the outer edge of the head bolt insertion hole boss at said partition wall front end side, and said heat insulating layer extends along the outer circumference of a thin partition wall extending in arc shape about the axis of the head bolt insertion hole along the outer edge of the oil passage.

3. A cylinder head where exhaust ports of adjoining cylinders are gathered together at an exhaust merging portion inside a cylinder head, a partition wall separating the exhaust ports of these adjoining cylinders extends from between these adjoining cylinders to the exhaust merging portion, a head bolt insertion hole is formed inside the partition wall, and an oil passage is formed inside the partition wall between a front end of the partition wall facing the exhaust merging portion and the head bolt insertion hole, wherein a heat insulating layer is formed inside the partition wall between the front end of the partition wall and the oil passage, wherein said heat insulating layer is comprised of blowby gas passage.

* * * * *